US008346129B2

(12) United States Patent
Ukai

(10) Patent No.: US 8,346,129 B2
(45) Date of Patent: Jan. 1, 2013

(54) IMAGE FORMING DEVICE HAVING A MECHANISM FOR DRIVING A FIXING ROLLER

(75) Inventor: Masamitsu Ukai, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 549 days.

(21) Appl. No.: 12/394,141

(22) Filed: Feb. 27, 2009

(65) Prior Publication Data

US 2009/0214242 A1 Aug. 27, 2009

(30) Foreign Application Priority Data

Feb. 27, 2008 (JP) ..... 2008-046155

(51) Int. Cl.
*G03G 15/16* (2006.01)

(52) U.S. Cl. ..... 399/122; 399/67; 399/328

(58) Field of Classification Search ..... 399/67, 399/38, 75, 122, 167, 320, 328, 330–332, 399/335; 219/216, 244
See application file for complete search history.

(56) References Cited

U.S. PATENT DOCUMENTS

| | | | | |
|---|---|---|---|---|
| 6,181,891 | B1 * | 1/2001 | Higashi et al. | 399/70 |
| 2003/0170048 | A1 * | 9/2003 | Ahn | 399/167 |
| 2005/0158075 | A1 * | 7/2005 | Echigo et al. | 399/122 |
| 2006/0182465 | A1 * | 8/2006 | Funamoto et al. | 399/167 |
| 2006/0188291 | A1 * | 8/2006 | Kawakami et al. | 399/167 |

FOREIGN PATENT DOCUMENTS

| | | |
|---|---|---|
| JP | 03-261964 | 11/1991 |
| JP | 05-063911 | 3/1993 |
| JP | 07-172600 | 7/1995 |
| JP | 11-024351 | 1/1999 |
| JP | 2003-122178 | 4/2003 |
| JP | 2006-208916 | 8/2006 |
| JP | 2006-283980 | 10/2006 |
| JP | 2007-047471 | 2/2007 |
| JP | 2007-171606 | 7/2007 |

OTHER PUBLICATIONS

Office Action received in counterpart JP Application No. 2008-046155, mailed Feb. 23, 2010.

* cited by examiner

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

An image forming device, configured to form an image on a sheet in an electrophotographic method, includes a fixing roller thermally fixing a developer image on the sheet, a driving unit generating a driving force, a first rotating body configured to be driven by the driving force and rotate the fixing roller, a clutch mechanism provided on a power transmission route to transmit the driving force from the driving unit to the first rotating body, the clutch mechanism switching between a state to transmit the driving force to the first rotating body and a state to block transmission of the driving force to the first rotating body, a second rotating body provided at a downstream side relative to the clutch mechanism on the power transmission route so as to rotate in conjunction with the first rotating body, a detecting unit detecting whether the second rotating body is rotating.

13 Claims, 12 Drawing Sheets

FIG. 6
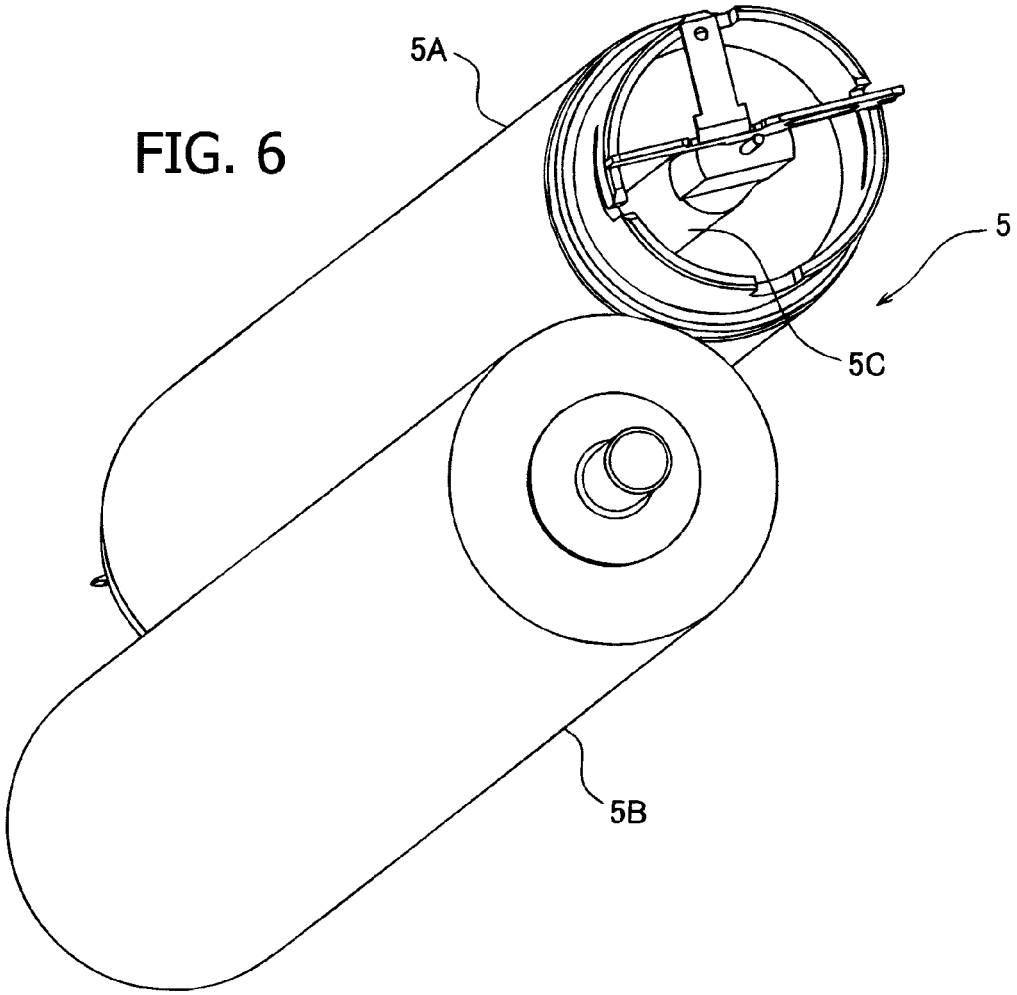
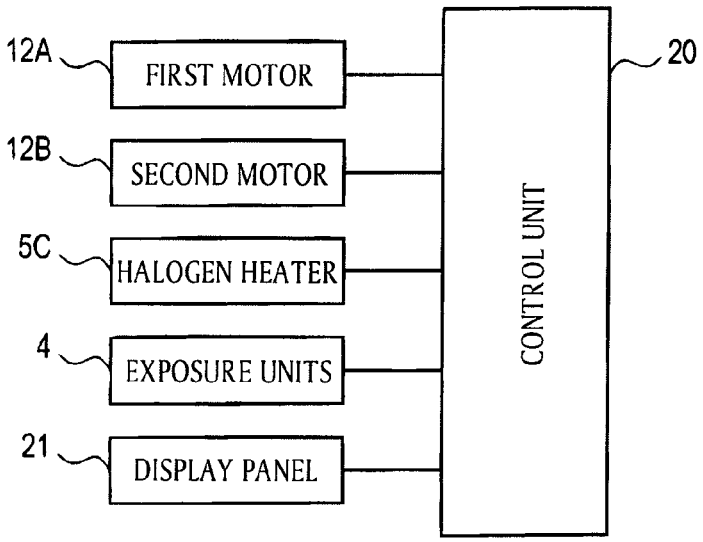
FIG. 7

IMAGE FORMING DEVICE HAVING A MECHANISM FOR DRIVING A FIXING ROLLER

CROSS-REFERENCE TO RELATED APPLICATION

This application claims priority under 35 U.S.C. §119 from Japanese Patent Application No. 2008-046155 filed on Feb. 27, 2008. The entire subject matter of the application is incorporated herein by reference.

BACKGROUND

1. Technical Field

The following description relates to one or more electrophotographic image forming devices that includes a heating unit configured to heat and fix a developer image transferred onto a recording medium such as a sheet.

2. Related Art

For example, Japanese Patent Provisional Publication No. 2006-283980 discloses a mechanism configured such that a driving force generated by a motor is transmitted to a driving gear for rotating a heating roller via a pendular gear. It is noted that the pendular gear is a kind of clutch mechanism configured to switch between a state where the pendular gear is engaged with the driving gear to transmit the driving force with the driving gear and a state where the pendular gear is spaced apart from the driving gear to block the transmission of the driving force.

SUMMARY

In the meantime, when the heating roller is kept in a non-rotated state, heat generated by the heating roller might have an undesired influence on the sheet. Therefore, when the transmission of the driving force is left blocked although the motor is rotating, the heating roller remains in the non-rotated state, and thereby an undesired influence might be exercised on the sheet.

Aspects of the present invention are advantageous to provide one or more improved image forming devices adopted to prevent a heating roller from being kept in a non-rotated state for longer than a predetermined time period although a motor is rotating.

According to aspects of the present invention, an image forming device, configured to form an image on a sheet in an electrophotographic method, is provided. More specifically, the image forming device includes a fixing roller configured to rotate in contact with the sheet and thermally fix a developer image transferred onto the sheet while feeding the sheet, a driving unit configured to generate a driving force, a first rotating body configured to be driven by the driving force generated by the driving unit and rotate the fixing roller, a clutch mechanism provided on a power transmission route on which the driving force is transmitted from the driving unit to the first rotating body, the clutch mechanism being configured to switch between a state to transmit the driving force to the first rotating body and a state to block transmission of the driving force to the first rotating body, a second rotating body provided on a downstream side route as a route at a downstream side relative to the clutch mechanism on the power transmission route, the second rotating body being configured to rotate in conjunction with the first rotating body, and a detecting unit configured to detect whether the second rotating body is rotating.

In some aspects of the present invention, by detecting with the detecting unit whether the second rotating body, adopted to rotate in conjunction with the first rotating body, is rotating, it is possible to detect whether the first rotating body is rotating by the driving force generated by the driving unit. Thereby, it is possible to prevent the fixing roller (i.e., a heating roller) from being kept in a non-rotated state for longer than a predetermined time period although the driving unit generates the driving force.

BRIEF DESCRIPTION OF THE ACCOMPANYING DRAWINGS

FIG. 6 is a perspective view showing a fixing unit in the first embodiment according to one or more aspects of the present invention.

FIG. 7 is a block diagram schematically showing an electrical configuration of the image forming device in the first embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Hereinafter, embodiments according to aspects of the present invention will be described with reference to the accompanying drawings. It is noted that, in the following embodiments, an electrophotographic image forming device is applied to a color laser printer.

First Embodiment

Schematic Configuration of Image Forming Device

Figure 1:
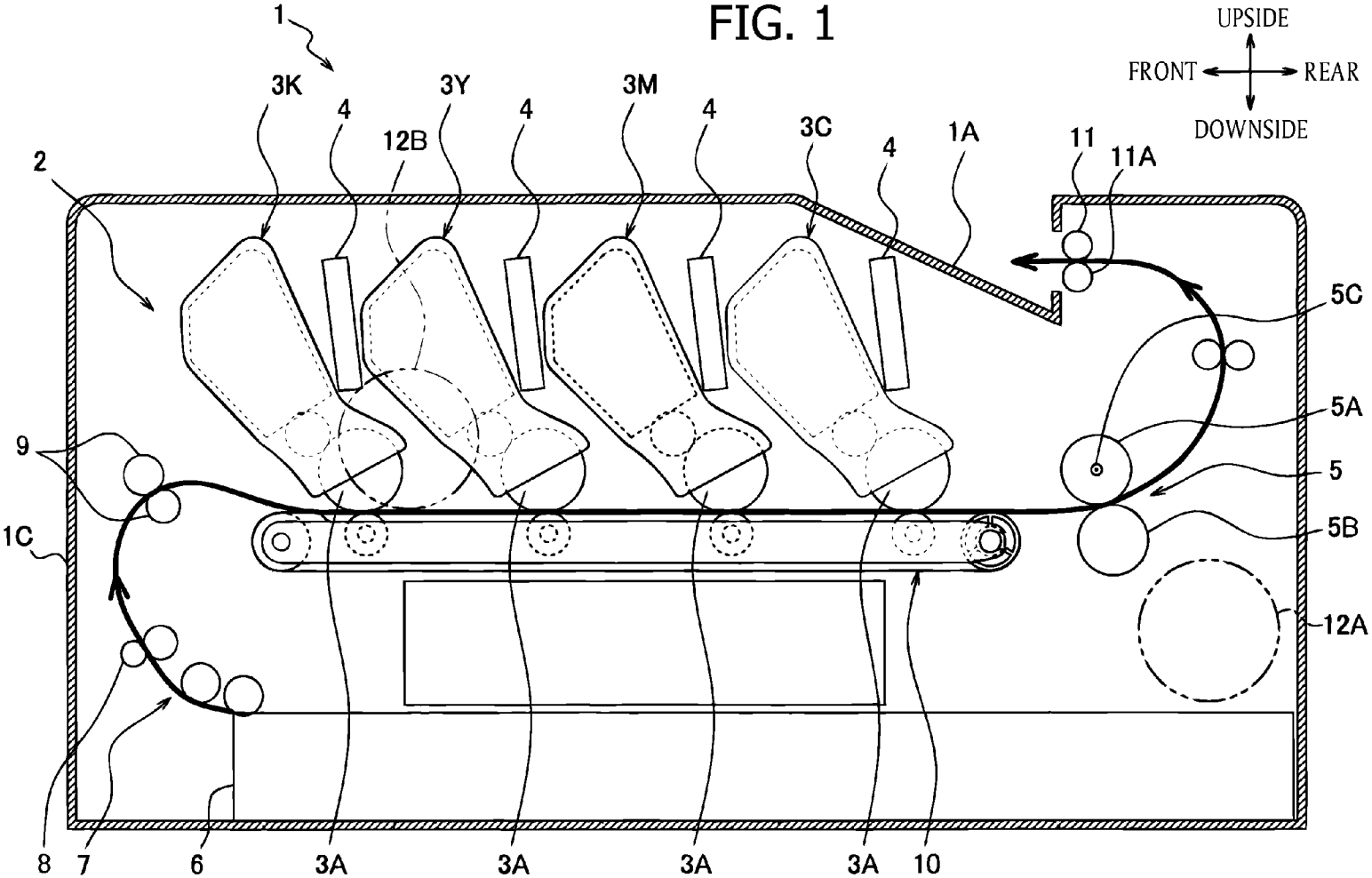
FIG. 1 is a cross-sectional side view schematically showing an internal configuration of an image forming device in a first embodiment according to one or more aspects of the present invention.

As illustrated in FIG. 1, an image forming device 1 in a first embodiment according to aspects of the present invention includes an image forming unit 2 configured to form an image on a sheet or a transparent sheet for OHP (hereinafter, simply referred to as a sheet). The image forming unit 2 has four process cartridges 3K, 3Y, 3M, and 3C, four exposure units 4, and a fixing unit 5.

It is noted that a direct tandem method is applied to the image forming device 1 in the first embodiment. Specifically, in the image forming device 1, four kinds of developer images, which are formed by the four process cartridges 3K, 3Y, 3M, and 3C of the image forming unit 2 that respectively correspond to developers (toners) of four colors Black, Yellow, Magenta, and Cyan, are superimposed on a sheet, and a color image is formed on the sheet.

Among a stack of sheets placed on a sheet feed tray 6, a top sheet picked up by a sheet feeding mechanism (a feeder unit) 7 is carried to a pair of registration rollers 9 after paper powder attached onto the sheet is removed by a paper powder removing roller 8. Skew correction is executed for the sheet by the registration rollers 9, and thereafter the sheet is conveyed to a belt unit 10.

The four process cartridges are linearly disposed on a side of a sheet carrying surface of the belt unit 10 in an order of the cartridges 3K, 3Y, 3M, and 3C from an upstream side in a sheet carrying direction.

The four kinds of developer images are sequentially transferred onto the sheet being carried on the belt unit 10. Then, the developer images completely transferred are fixed onto the sheet through a heating treatment by the fixing unit 5.

The sheet on which the image formation has completely been achieved is discharged from the fixing unit 5, and the sheet carrying direction is directed upward. Thereafter, the sheet is discharged onto a catch tray 1A that is provided to a top cover 1B placed on an upper face side of the image forming device 1.

In addition, a discharge roller 11 is adopted to give a feeding force to the sheet when rotating in contact with the sheet. A pinch roller 11A is provided to face the discharge roller 11 and configured to press the sheet against the discharge roller 11.

Incidentally, the discharge roller 11 is rotated by a first motor 12A configured to drive a below-mentioned heating roller 5A, mechanically in conjunction with the heating roller 5A. Meanwhile, the pinch roller 11A is rotated along with contact with the sheet.

In addition, each of the process cartridge 3K, 3Y, 3M, and 3C has a photoconductive drum 3A and a charger (not shown) incorporated therein.

Here, the photoconductive drum 3A is adopted to hold a developer image thereon, and the charger is adopted to charge the photoconductive drum 3A. When the photoconductive drum 3A charged is exposed to the exposure unit 4, an electrostatic latent image is formed on an outer circumferential surface of the photoconductive drum 3A. After that, when developer is supplied to the photoconductive drum 3A, a developer image is held (formed) on the outer circumferential surface of the photoconductive drum 3A.

In addition, the fixing unit 5 is configured with a heating roller 5A adopted to rotate in contact with the sheet, a pressing roller 5B provided on a side opposite the heating roller 5A via the sheet fed and configured to press the sheet against the heating roller 5A, and a halogen heater 5C housed in the heating roller 5A.

Specifically, as illustrated in FIG. 6, the halogen heater 5C is housed in the cylindrical heating roller 5A and configured to heat the heating roller 5A from within. Further, the heating roller 5A is adopted to be heated by the halogen heater 5C and fix the developer image onto the sheet by heating while rotating with an outer circumferential surface thereof in contact with the sheet.

<Drive Mechanism for Heating Roller and Discharge Roller>

Figure 2:
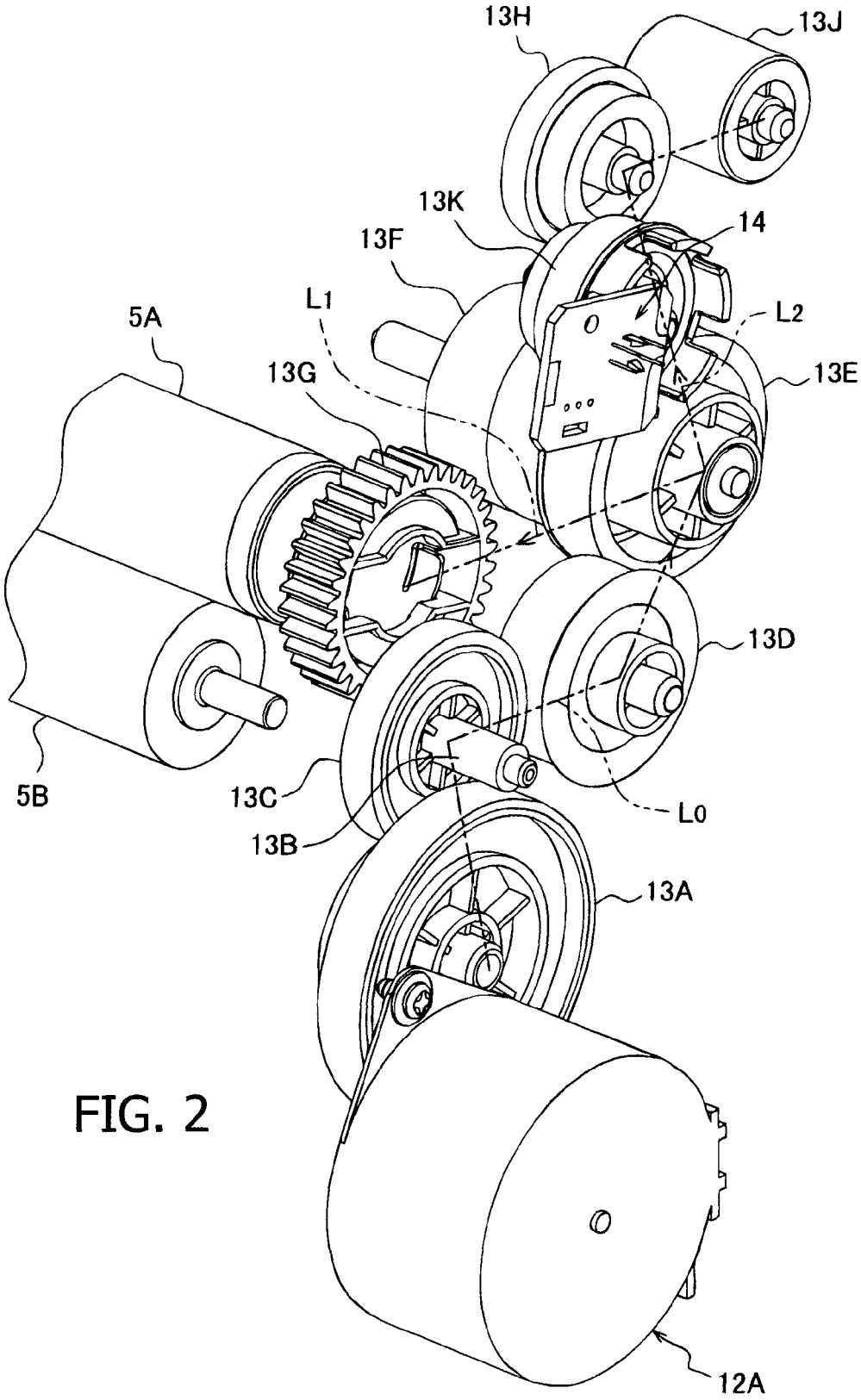
FIG. 2 is a perspective view schematically showing gears for rotating a heating roller in the first embodiment according to one or more aspects of the present invention.
Figure 3:
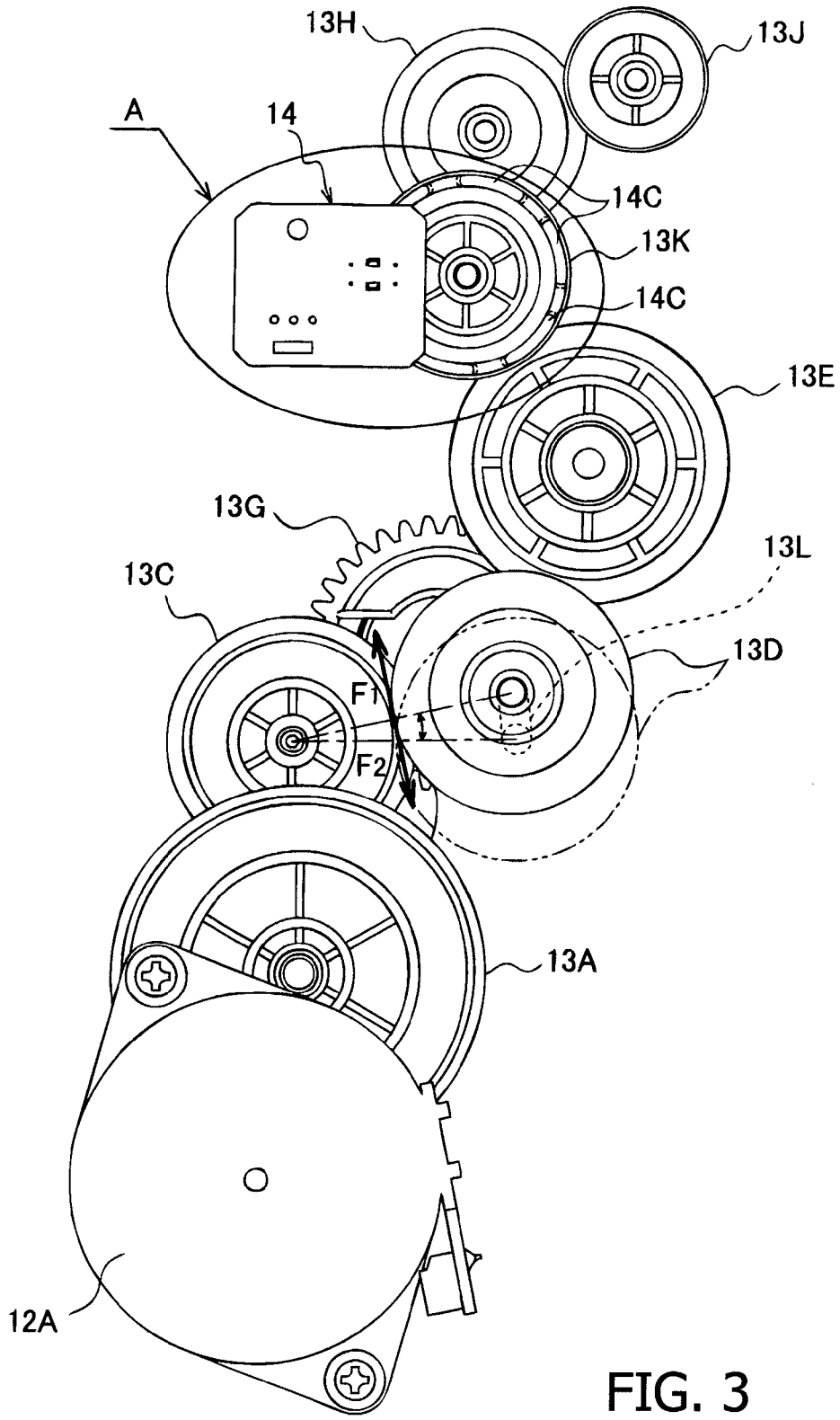
FIG. 3 is a side view schematically showing the gears for rotating the heating roller in the first embodiment according to one or more aspects of the present invention.

As shown in FIGS. 2 and 3, the heating roller 5A and the discharge roller 11 are rotated by a driving force from the first motor 12A as a common driving source therefor.

Further, the belt unit 10 is rotated by a driving force from a second motor 12B (see FIG. 1). In the first embodiment, the first motor 12A is configured with a stepper motor while the second motor 12B is configured with a DC motor.

A rotational shaft (not shown) of the heating roller 5A is, as illustrated in FIG. 2, provided with a gear 13G (hereinafter referred to as a roller gear 13G) configured to rotate integrally with the heating roller 5A. The driving force of the first motor 12A is transmitted to the roller gear 13G via gears 13A, 13B, 13C, 13D, 13E, and 13F in the aforementioned order.

Specifically, a power transmission route Lo for transmitting the driving force from the first motor 12A to the roller gear 13G diverges from the gear 13E (hereinafter referred to as a fixing drive gear 13E) in a first power transmission route L1 on a side of the roller gear 13G and a second power transmission route L2 on a side of a discharge drive gear 13J. Therefore, since the driving force generated by the first motor 12A is transmitted concurrently to the fixing drive gear 13E and the discharge driving gear 13J, the heating roller 5A and the discharge roller 11 are rotated in mechanical synchronization.

The discharge drive gear 13J is provided to a rotational shaft (not shown) of the discharge roller 11 and configured to rotate the discharge roller 11. Further, the discharge drive gear 13J is rotated by a driving force received from the fixing drive gear 13E via a gear 13K (hereinafter referred to as an idle gear 13K) and a gear 13H.

In addition, a gear (the gear 13D in the first embodiment) on the power transmission route Lo, which is located closer to the first motor 12A than the fixing drive gear 13E, is supported by a main body frame (not shown) swingably around a rotational center of the gear 13C.

It is noted that, in the first embodiment, a rotational shaft of the gear 13D (hereinafter referred to as a clutch gear 13D) is slidably attached into a circular arc elongate hole 13L formed on the main body frame, and thereby the clutch gear 13D is slidably supported.

Therefore, when being in a position indicated by a solid line in FIG. 3, the clutch gear 13D is engaged with the gear 13C and the fixing drive gear 13E. Thereby, the driving force generated by the first motor 12A is transmitted to the fixing drive gear 13E.

Meanwhile, when being in a position indicated by a chain double-dashed line in FIG. 3, the clutch gear 13D is engaged only with the gear 13C and not with the fixing drive gear 13E. Namely, in the first embodiment, the clutch gear 13D serves as a clutch mechanism to switch between a state where the driving force is transmitted to the roller gear 13 and a state where the transmission of the driving force to the roller gear 13 is blocked.

In the first embodiment, when a driving force in such a direction as to rotate the heating roller 5A counterclockwise in FIG. 1 is transmitted from the first motor 12A, a force F1 is generated on an engagement surface between the gear 13C and the clutch gear 13D (see FIG. 3). Therefore, the clutch gear 13D is moved to or held in the engagement position indicated by the solid line in FIG. 3, and the driving force is transmitted to the fixing drive gear 13E.

On the contrary, when a driving force in such a direction as to rotate the heating roller 5A clockwise in FIG. 1 is transmitted from the first motor 12A, a force F2 in a direction opposite to the direction of the force F1 is generated on the engagement surface between the gear 13C and the clutch gear 13D (see FIG. 3). Therefore, the clutch gear 13D is moved to the engagement position indicated by the chain double-dashed line in FIG. 3, and the transmission of the driving force is blocked.

It is noted that "such a direction as to rotate the heating roller 5A counterclockwise in FIG. 1" represents a direction in which the sheet is conveyed toward the catch tray 1A.

In addition, the idle gear 13K is provided with a rotation sensor 14 configured to detect whether the idle gear 13K is rotating. It is noted that the idle gear 13K is provided on the second power transmission route L2 at a downstream side of the clutch gear 13D on the power transmission route Lo. Further, the idle gear 13K is a gear, adopted to rotate in conjunction with the gear 13F, other than the gear 13F configured to transmit the driving force in direct engagement with the roller gear 13G.

Incidentally, in the first embodiment, since the gear 13F and the fixing drive gear 13E are integrated, the fixing drive roller 13E is regarded as a gear configured to transmit the driving force through direct engagement with the roller gear 13G.

Figure 4A:
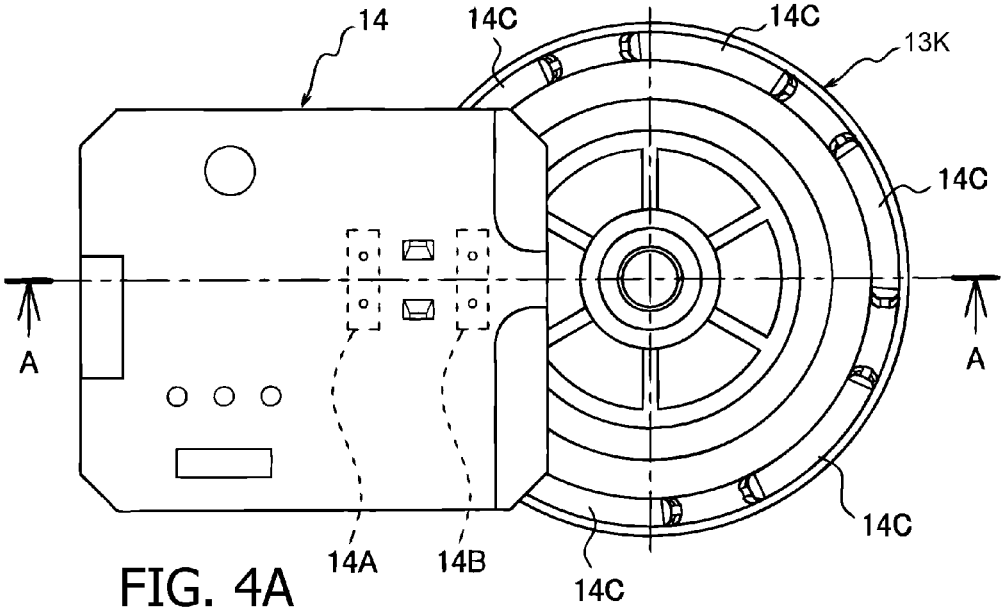
FIG. 4A is an enlarged view of a portion A shown in FIG. 3 in the first embodiment according to one or more aspects of the present invention.
Figure 4B:
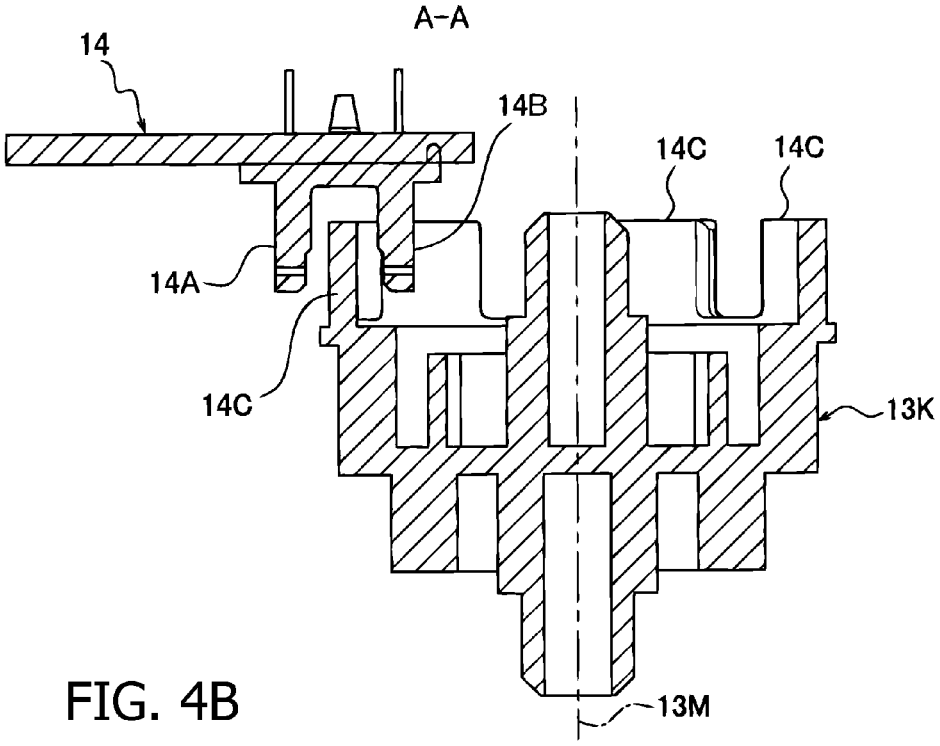
FIG. 4B is a cross-sectional view of the structure shown in FIG. 4A along a line A-A indicated in FIG. 4A in the first embodiment according to one or more aspects of the present invention.
Figure 5:
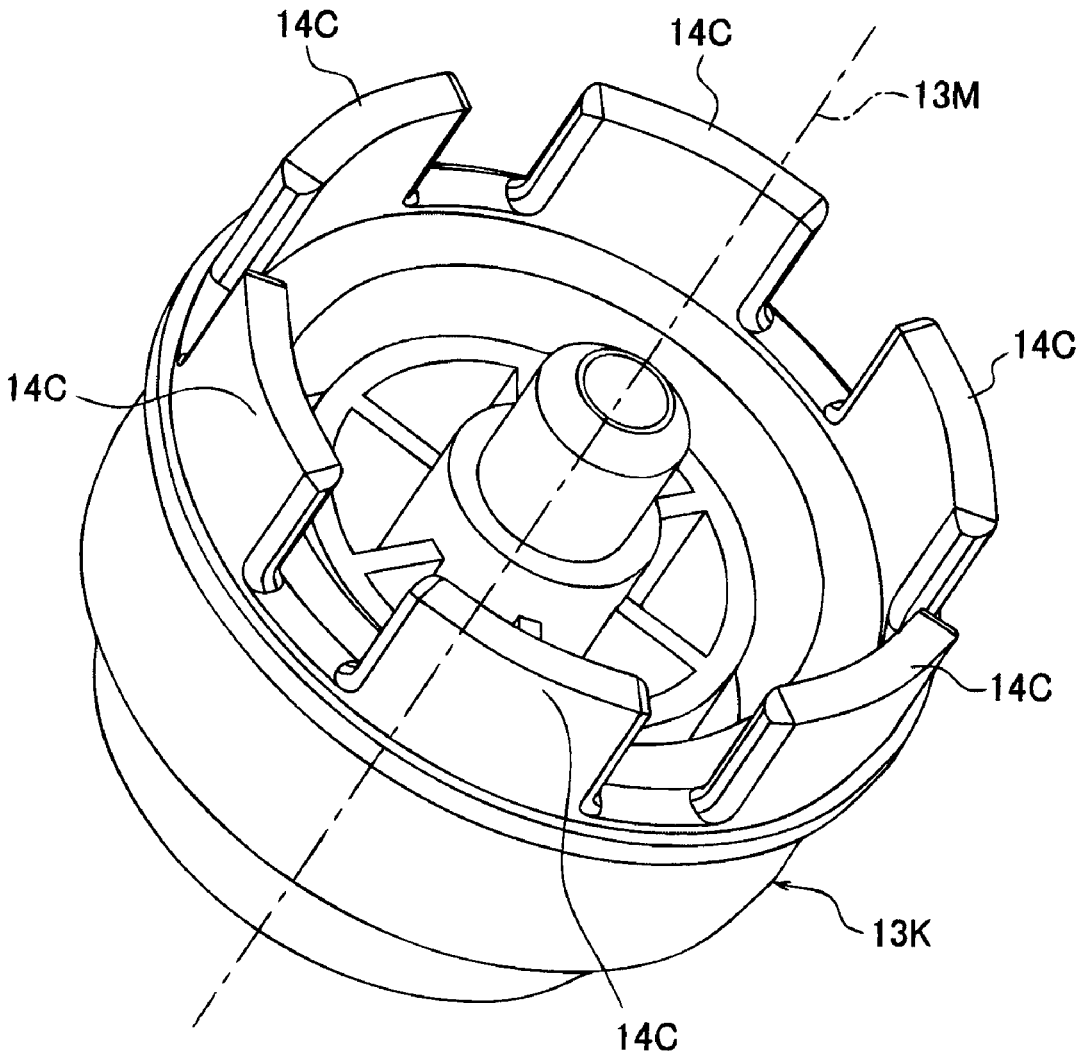
FIG. 5 is a perspective view showing an idle gear in the first embodiment according to one or more aspects of the present invention.

As illustrated in FIGS. 4A and 4B, the rotation sensor 14 is a transmission optical sensor provided with a light emitting element 14A and a light receiving element 14B. Specifically, as shown in FIG. 5, a plurality of projections 14C are provided at an outermost circumferential side on a side face of the idle gear 13K. The projections 14C are configured to protrude in a direction parallel to a rotational axis 13M of the idle gear 13K and to rotate around the rotational axis 13M integrally with the idle gear 13K. The projections 14C are aligned discretely at regular intervals to form a gap between any two of adjacent projections 14C.

As shown in FIG. 4B, the light emitting element 14A and the light receiving element 14B are disposed to face one another via the projections 14C in a radial direction of the idle gear 13K. In the first embodiment, the light emitting element 14A is placed outside the projections 14C in the radial direction. Further, the light receiving element 14B is placed inside the projections 14C in the radial direction.

<Schematic Electrical Configuration of Image Forming Device>

As illustrated in FIG. 7, the first motor 12A, the second motor 12B, and the halogen heater 5C are controlled by a control unit 20. The control unit 20 is configured with a known microcomputer including a CPU, a ROM, and a RAM.

A display panel 21 is configured to notify a user of various kinds of information and controlled by the control unit 20.

Figure 8:
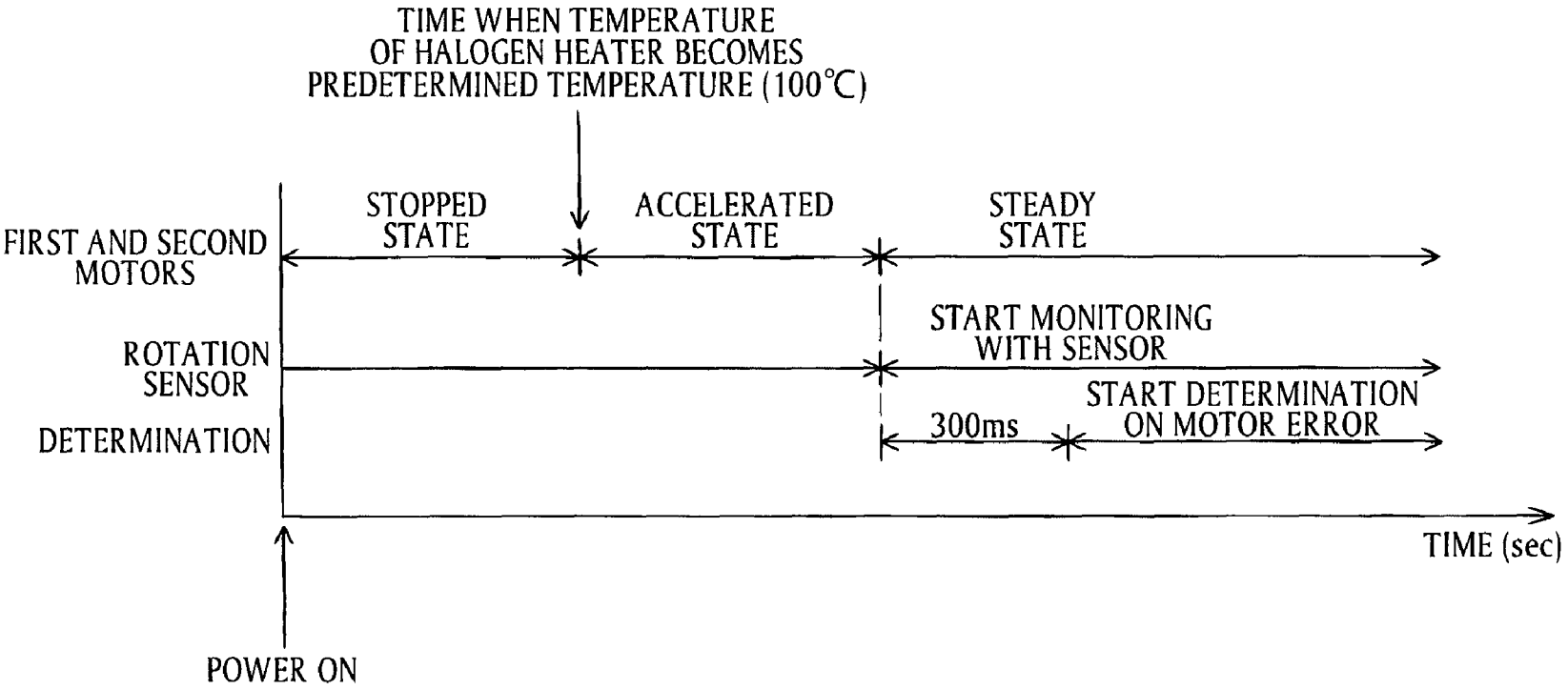
FIG. 8 is a chart showing operation timing of a first motor in a warming-up operation of the image forming device in the first embodiment according to one or more aspects of the present invention.

When the image forming device 1 is powered on, firstly a warming-up operation as shown in FIG. 8 is launched.

Specifically, concurrently with the power-on operation for the image forming device 1, an electrical power is supplied to the halogen heater 5C and automatically controlled to set a temperature of the halogen heater 5C within a predetermined temperature range.

Until the temperature of the halogen heater 5C becomes a predetermined temperature (e.g., 100 degrees C.) lower than a fixing temperature, the first and second motors 12A and 12B are kept in a standby state. Then, when the temperature of the halogen heater 5C becomes the predetermined temperature, the electrical power is supplied to the first and second motors 12A and 12B, and the image forming device 1 is set to a steady state via an accelerated state. It is noted that the steady state represents a state where a sheet carrying speed of the image forming device 1 is a constant speed previously set.

Subsequently, after the image forming device 1 is set in the steady state (namely, after the accelerated state is completed), monitoring with the rotation sensor 14 is started. Then, when a predetermined time period (in the first embodiment, 300 ms) has elapsed after the monitoring was started, it is determined whether the idle gear 13K is rotating.

It is noted that, in the first embodiment, the determination whether the image forming device 1 is in the steady state is made based on a predetermined elapsed time period after the electrical power was supplied to the first and second motors 12A and 12B. Further, the predetermined elapsed time period is set for each image forming device 1 as well as the predetermined time period after the monitoring was started.

Figure 9:
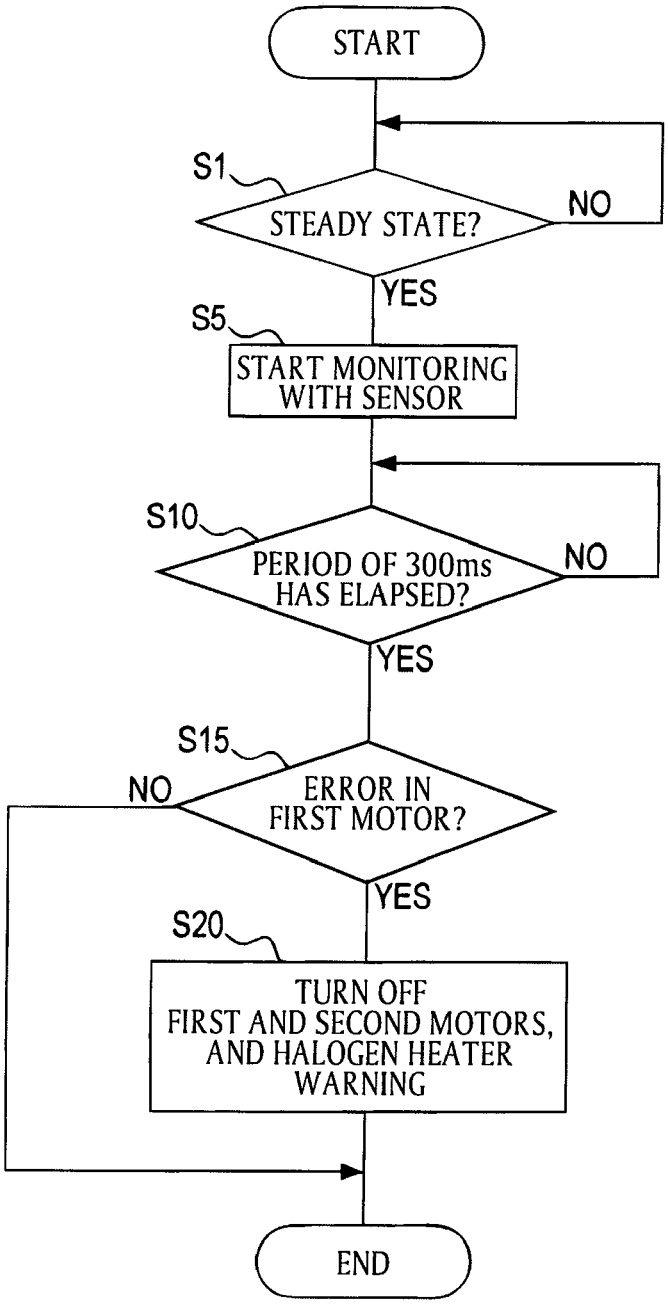
FIG. 9 is a flowchart showing a procedure of control in the warming-up operation of the image forming device in the first embodiment according to one or more aspects of the present invention.

FIG. 9 is a flowchart showing a procedure of the aforementioned control in the warming-up operation. The control is launched when the image forming device 1 is powered on, and terminated when the warming-up operation is completed.

Specifically, when the image forming device 1 is powered on, firstly, it is determined whether the image forming device 1 is in the steady state (S1). At this time, when the image forming device 1 is in the standby state owing to no printing assigned or in the accelerated state, it is determined that the image forming device 1 is not in the steady state (S1: No). Then, the step S1 is repeatedly executed until the image forming device 1 is determined to be in the steady state (S1: Yes).

When the image forming device 1 is determined to be in the steady state (S1: Yes), the monitoring with the rotation sensor 14 is started (S5), and it is determined whether a predetermined time period (in the first embodiment, 300 ms) has elapsed since the monitoring was started (S10).

When it is determined that the predetermined time period has elapsed since the monitoring was started (S10: Yes), it is determined whether an error is caused in the first motor 12A based on a detection result of the rotation sensor 14, namely, whether the idle gear 13K is actually rotating (S15).

Reasons why the idle gear 13K does not rotate include that the first motor 12A does not rotate due to a step-out problem and that the driving force is not transmitted from the clutch gear 13D to the roller gear 13G since the clutch gear 13D is not normally engaged with the roller gear 13C (or the fixing drive gear 13E).

Meanwhile, when the predetermined time period has not elapsed since the monitoring was started (S10: No), it is not determined whether an error is caused in the first motor 12A, and the monitoring is continued until the predetermined time period has elapsed since the monitoring was started.

When it is determined that an error is caused in the first motor 12A (S15: Yes), the electrical power supply to the first and second motors 12A and 12B and the halogen heater 5C is blocked, and a warning message is displayed on the display panel 21 to inform that (S20). After that, the control is terminated.

Meanwhile, when it is determined that an error is not caused in the first motor 12A (S15: No), the control is terminated based on determination that the warming-up operation has normally been performed.

<Features of Image Forming Device in First Embodiment>

In the first embodiment, it is detected whether the idle gear 13K is rotating, which is a gear, configured to rotate in conjunction with the roller gear 13G, on the second power transmission route L2 at the downstream side of the clutch gear 13D on the power transmission route Lo. Therefore, it is possible to detect whether the roller gear 13Q namely, the heating roller 5A is being rotated by the driving force supplied from the first motor 12A.

Accordingly, it is possible to prevent the heating roller 5A from being kept in a non-rotated state for longer than a predetermined time period although the driving force is supplied from the first motor 12A to the heating roller 5A or because the first motor cannot rotate due to the step-out problem.

In the meantime, in the first embodiment, it is detected whether the idle gear 13K is rotating. It is noted that the idle gear 13K is a gear, on the second power transmission route L2, other than the gear 13F configured to transmit the driving force in contact with the roller gear 13G. Further, the idle gear 13K is adopted to rotate in conjunction with the gear 13F.

At this time, the gear 13F configured to transmit the driving force in contact with the roller gear 13G is inevitably close to the heating roller 5A. Therefore, when a rotational state of the gear 13F is detected, an expensive thermally-stable sensor has to be employed.

On the contrary, in the first embodiment, a rotational state of the idle gear 13K is detected. It is noted that the idle gear 13K is a gear, other than the gear 13F, adopted to rotate in conjunction with the gear 13F. Thereby, it is possible to prevent the rotation sensor 14 from being thermally influenced, better than when the rotational state of the gear 13F is detected.

Further, in the first embodiment, as illustrated in FIG. 4B, the rotation sensor 14 is provided at a side of the side face of the idle gear 13K to detect the rotational state of the idle gear 13K. Hence, it is possible to avoid a malfunction of the rotation sensor 14.

Specifically, since a gear has a risk that teeth thereof might be worn due to friction caused on surfaces of the teeth, lubricant such as grease is applied on the teeth. Therefore, when the idle gear 13K as such a gear rotates, lubricant applied on teeth provided an outer circumferential portion of the idle gear 13K might be sputtered due to a centrifugal force.

Accordingly, when the rotation sensor 14 as an optical sensor is supposedly provided at an outer circumferential side of the idle gear 13K, sputtered lubricant is highly likely to be adhered to the light emitting element 14A and/or the light receiving element 14B. When the lubricant is adhered to the light emitting element 14A and/or the light receiving element 14B, it causes malfunction of the rotation sensor 14.

On the contrary, in the first embodiment, the rotation sensor 14 is provided at the side of the side face of the idle gear 13K. Thus, it is possible to prevent the sputtered lubricant from being adhered to the light emitting element 14A and/or the light receiving element 14B, and thereby avoid malfunction of the rotation sensor 14.

Figure 10:
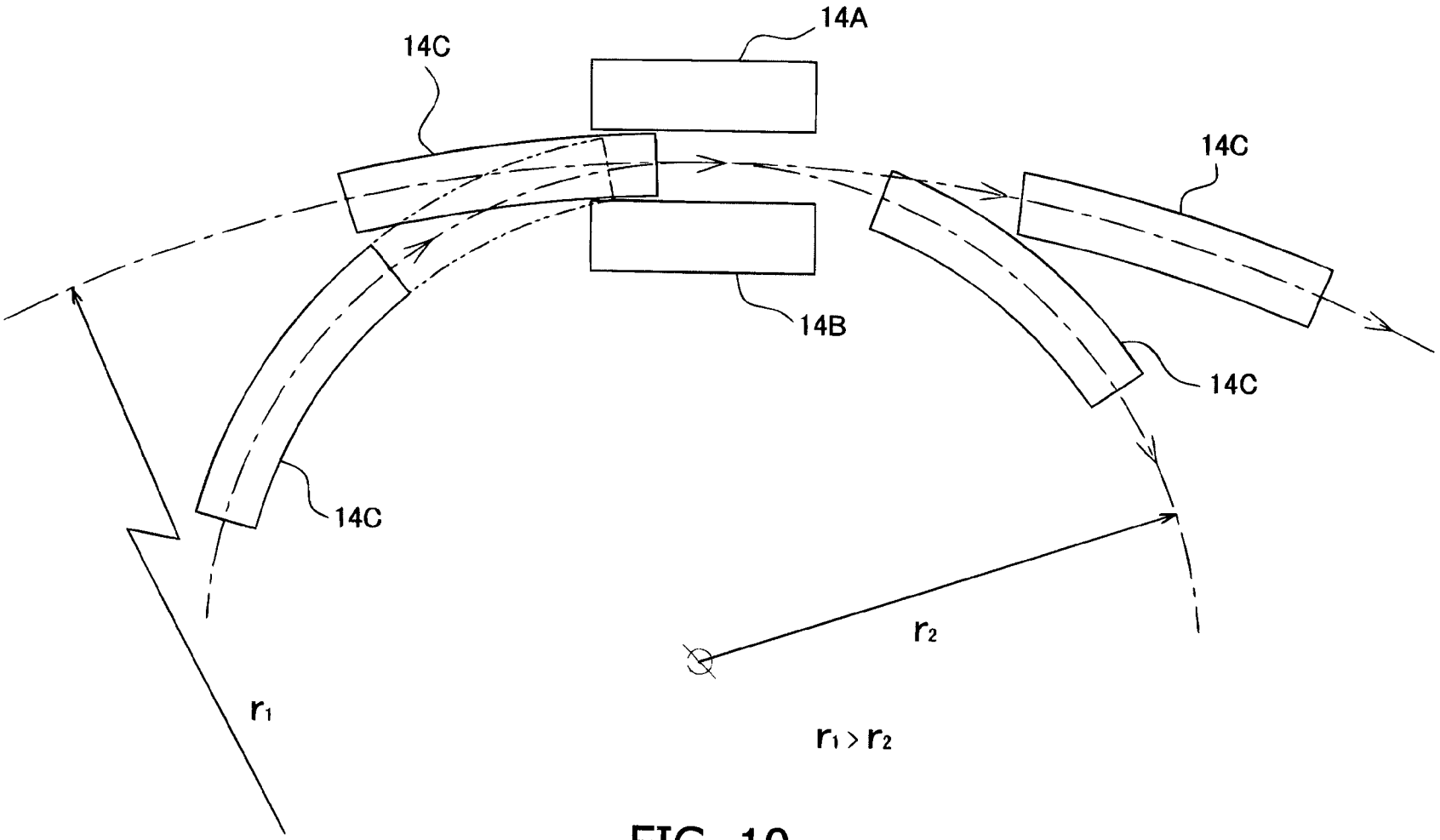
FIG. 10 is a schematic diagram showing relationships between a rotation sensor and projections in the cases of different projection radiuses in the first embodiment according to one or more aspects of the present invention.

In the meantime, in the first embodiment, the projections 14C is adopted to rotate integrally with the idle gear 13K while passing through the gap between the light emitting element 14A and the light receiving element 14B. At this time, as shown in FIG. 10, as a radial distance from the rotational center of the idle gear 13 to the projections 14C (hereinafter referred to as a projection radius) becomes longer, the projections 14C pass more linearly through the gap between the light emitting element 14A and the light receiving element 14B (in a state where the projection radius=r1). Meanwhile, as the projection radius becomes shorter, the projections 14C are required to be provided in an accurate position in a radial direction within the gap between the light emitting element 14A and the light receiving element 14B (in a state where the projection radius=r2).

Therefore, the smaller the projection radius is in the case of a small gap between the light emitting element 14A and the light receiving element 14B, the higher a risk that the projections 14C interferes with one of the light emitting element 14A and the light receiving element 14B (in the first embodiment, the light receiving element 14B) is.

On the contrary, in the first embodiment, the projections 14C are provided at the outermost circumferential side on the side face side of the idle gear 13K. Hence, the projection radius can be designed to be as large as possible, and thereby the radial position of the projections 14C can easily be adjusted to avoid the interference between the projections 14C and the light receiving element 14B.

Further, in the first embodiment, it is determined in the warming-up operation whether the idle gear 13K is rotating. The same determination is as well made in a regular printing operation (when a print command is issued).

Second Embodiment

Figure 11:
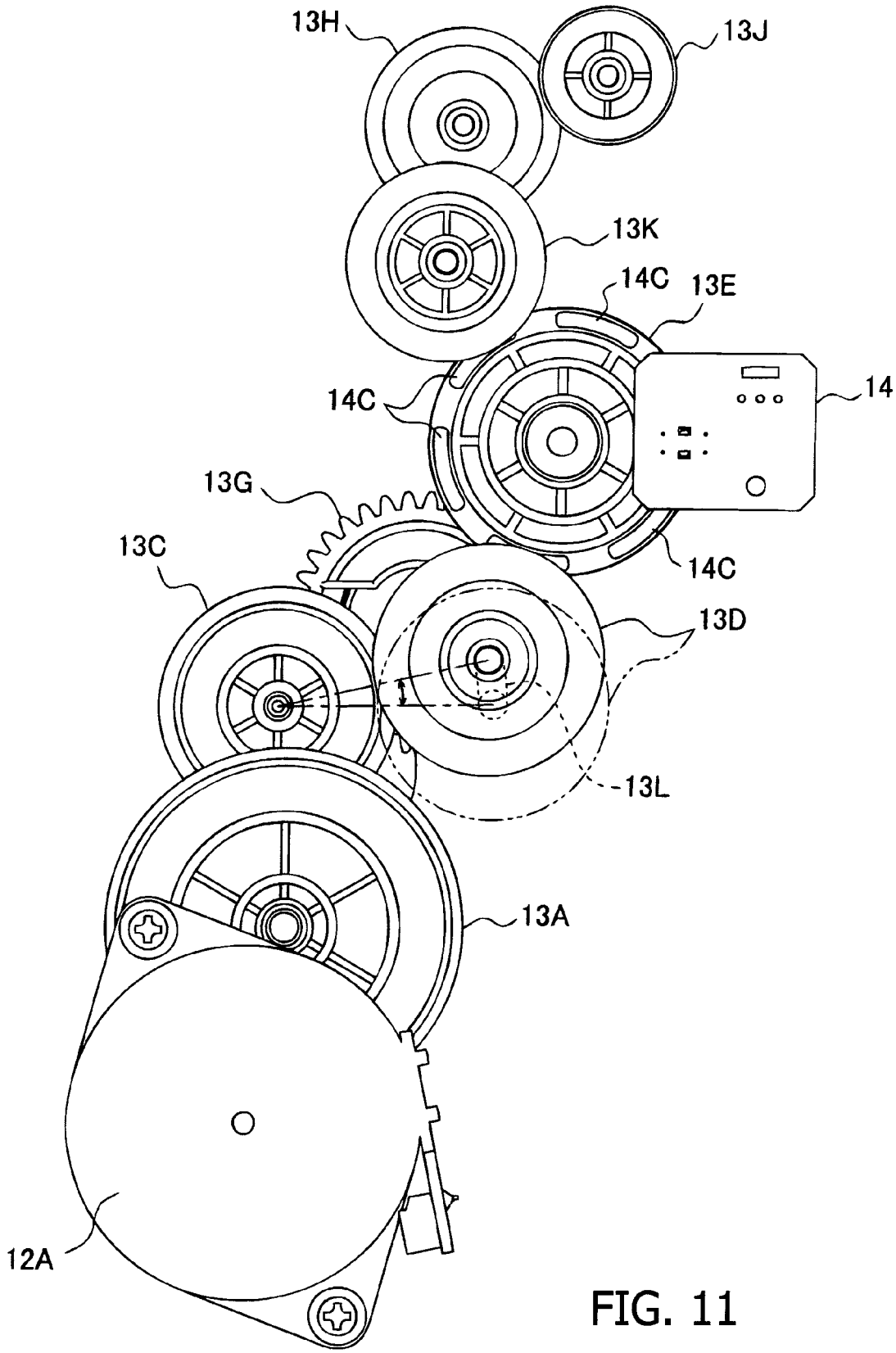
FIG. 11 is a side view schematically showing gears for rotating the heating roller in a second embodiment according to one or more aspects of the present invention.

Subsequently, a second embodiment according to aspects of the present invention will be described. In the second embodiment, as illustrated in FIG. 11, in order to detect the rotational state of the heating roller 5A, the projections 14C are provided to a gear with the largest diameter (in the second embodiment, the fixing drive gear 13E) among the gears on the second power transmission route L2.

In the same manner as the first embodiment, in the second embodiment as well, the projection radius can be designed to be large. Therefore, it is possible to avoid the interference between the projections 14C and the light receiving element 14B. It is noted that, in the second embodiment, the projections 14C are provided at an outermost circumferential side of a gear with the largest diameter among the gears on the second power transmission route L2. Thereby, the projection radius can be designed to be further larger.

Third Embodiment

Figure 12:
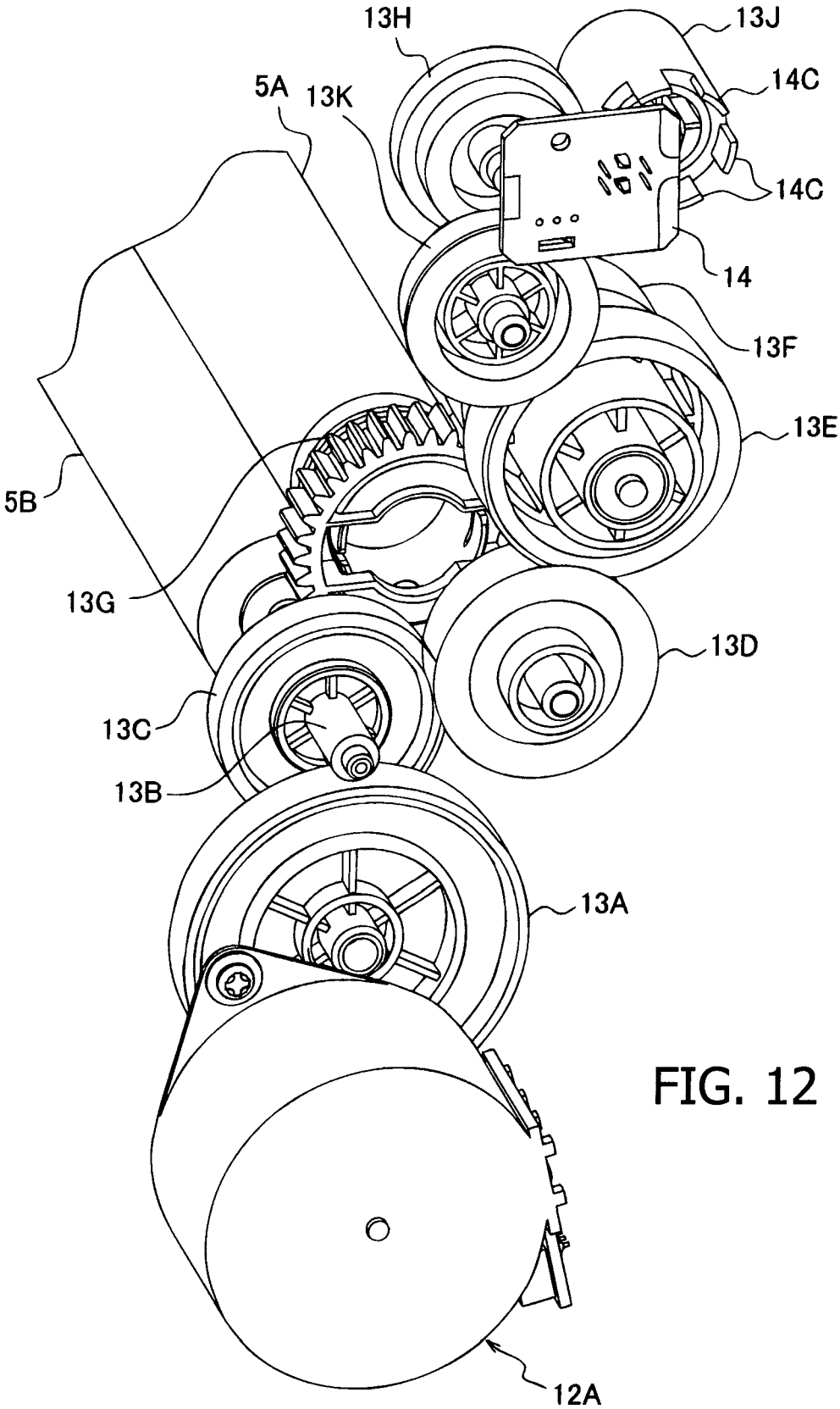
FIG. 12 is a perspective view schematically showing gears for rotating the heating roller in a third embodiment according to one or more aspects of the present invention.

Next, a third embodiment according to aspects of the present invention will be explained. In the third embodiment, as illustrated in FIG. 12, in order to detect the rotational state of the heating roller 5A, the projections 14C are provided to the discharge drive gear 13J. The discharge drive gear 13J is placed farther from the fixing drive gear 13E than any other gear on the second power transmission route L2 that diverges from the fixing drive gear 13E on the downstream-side power transmission route so as to transmit the driving force to gears (including the discharge drive gear 13J in the third embodiment) other than the roller gear 13G.

Thereby, in the third embodiment, the rotational state of the heating roller 5A is detected with the discharge drive gear 13J provided in a position farthest from the fixing drive gear 13E on the second power transmission route L2 where it is hard to receive a thermal influence from the heating roller 5A. Therefore, it is possible to avoid malfunction of the rotation sensor 14 due to the thermal influence.

Fourth Embodiment

Figure 13:
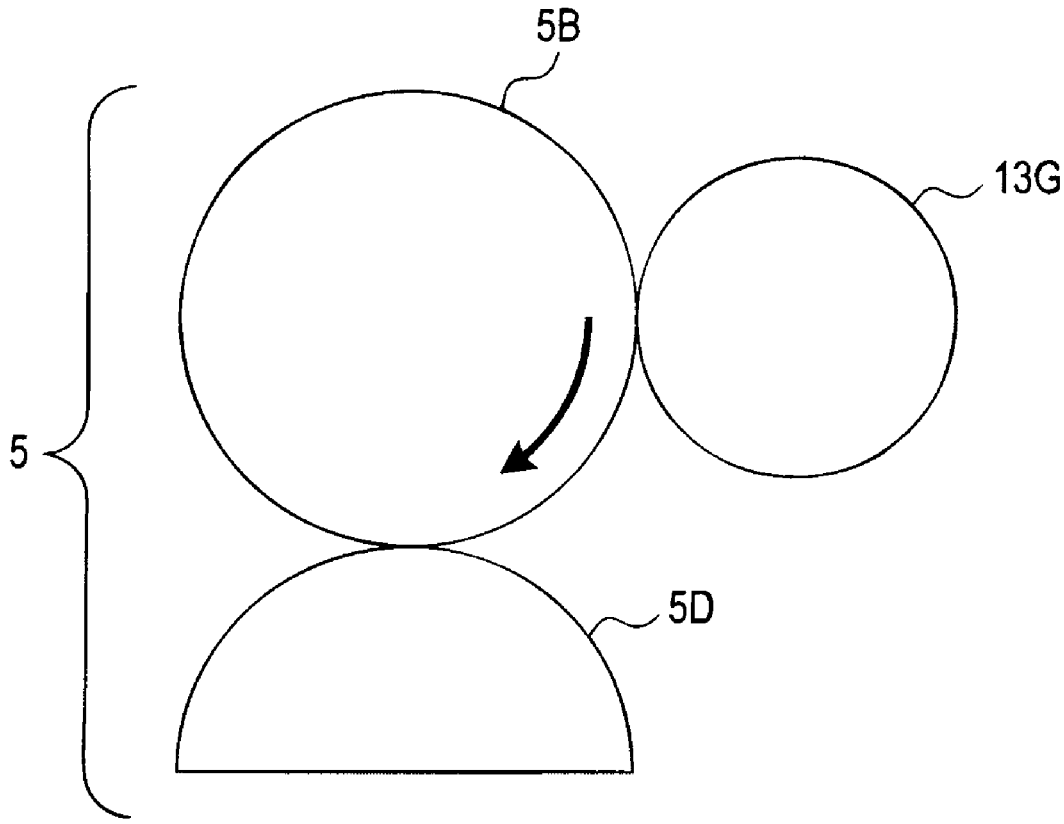
FIG. 13 is a schematic diagram showing a fixing unit in a fourth embodiment according to one or more aspects of the present invention.

Subsequently, a fourth embodiment according to aspects of the present invention will be explained. In the aforementioned embodiments, the halogen heater 5C is provided in the heating roller 5A. In the fourth embodiment, as shown in FIG. 13, a heating unit 5D is provided as a non-rotating fixed member to heat and fix a developer image transferred onto a sheet. Further, the heating unit 5D has a smoothly curved contact surface adopted to contact the sheet. In this configuration, the pressing roller 5B is adopted to press the sheet against the heating unit 5D.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein. For example, the present invention is capable of the following modifications.

<Modifications>

In the aforementioned embodiments, the driving force is transmitted with gears. However, a revolving body such as a belt or a rotating body such as a shaft may be employed to transmit the driving force.

In the aforementioned embodiments, the clutch gear 13D configured to pendulum is employed as a clutch unit. However, other clutch mechanisms such as an electromagnetic clutch may be employed.

In the aforementioned embodiments, a transmission optical sensor is employed as a detecting unit. However, for example, a reflective optical sensor may be employed as a detecting unit.

In the aforementioned embodiments, the rotation sensor 14 is provided on a side of a side face of a gear. Aspects of the present invention are not limited to such a configuration. Further, a gear with the rotation sensor 14 provided thereto is not limited to the gears exemplified in the aforementioned embodiments.

In the aforementioned embodiments, aspects of the present invention are applied to a color image forming device. However, for example, aspects of the present invention may be applied to a monochrome image forming device.

In the aforementioned embodiments, an exposure unit is configured with LEDs. However, for example, an exposure unit may be configured to scan a photoconductive body with laser light.

In the aforementioned embodiments, a direct tandem method is employed to form a color image on a sheet by superimposing on the sheet four kinds of developer images formed by the four process cartridges 3K, 3Y, 3M, and 3C of the image forming unit 2 that correspond to four colors of developers, respectively. However, aspects of the present invention may be applied to an image forming device using an intermediate transfer method, an image forming device adopted just for monochrome printing, or an image forming device provided with two or three process cartridges.

What is claimed is:

1. An image forming device configured to electrophotographically form an image on a sheet, the image forming device comprising:

a fixing roller configured to rotate in contact with the sheet and thermally fix a developer image transferred onto the sheet while feeding the sheet;

a driving unit configured to generate a driving force;

a first rotating body configured to be driven by the driving force generated by the driving unit and rotate the fixing roller;

a clutch mechanism provided on a power transmission route on which the driving force is transmitted from the driving unit to the first rotating body, the clutch mechanism being disposed downstream of the driving unit and upstream of the first rotating body on the power transmitting route, the clutch mechanism being configured to switch between a state for transmitting the driving force to the first rotating body and a state for blocking transmission of the driving force to the first rotating body;

a second rotating body provided on a downstream side route, wherein the downstream side route corresponds to a route at a downstream side of the clutch mechanism on the power transmission route, the second rotating body being configured to rotate in conjunction with the first rotating body; and a detecting unit disposed to face the second rotating body at the downstream side of the clutch mechanism on the power transmitting route, the detecting unit being configured to detect whether the second rotating body is rotating to indirectly detect whether the fixing roller is rotating.

2. The image forming device according to claim 1, further comprising a third rotating body provided on the downstream side route, the third rotating body being configured to transmit the driving force while in contact with the first rotating body, wherein the second rotating body is different from the third rotating body.

3. The image forming device according to claim 2, wherein the first to third rotating bodies are gears.

4. The image forming device according to claim 2, wherein the downstream side route includes a first route and a second route, wherein the power transmission route diverges at the third rotating body into the first and second routes, wherein the first rotating body is provided on the first route, and wherein the second rotating body is provided on the second route.

5. The image forming device according to claim 4, wherein the second rotating body is provided farther from the third rotating body than any other rotating body on the second route.

6. The image forming device according to claim 1, wherein the detecting unit includes an optical sensor, and wherein the optical sensor includes a light emitting element and a light receiving element.

7. The image forming device according to claim 6, wherein the detecting unit is provided on a side of a side face of the second rotating body to detect a rotational state of the second rotating body.

8. The image forming device according to claim 7, wherein the second rotating body includes a projection provided on the side face of the second rotating body, the projection being configured to protrude in a direction parallel to an rotational axis of the second rotating body, the projection being configured to revolve around the rotational axis of the second rotating body in an integral manner with the second rotating body, and wherein the detecting unit is configured such that the light emitting element faces the light receiving element face via the projection in a radial direction of the second rotational direction.

9. The image forming device according to claim 8, wherein the projection is provided at an outermost circumferential side on the side face of the second rotating body.

10. The image forming device according to claim 9, wherein the light emitting element of the detecting unit is disposed outside the projection in the radial direction of the second rotating body, and wherein the light receiving element of the detecting unit is disposed inside the projection in the radial direction of the second rotating body.

11. The image forming device according to claim 8, wherein the second rotating body has a diameter larger than a diameter of any other rotating body on the downstream side route.

12. The image forming device according to claim 1, further comprising a fixing unit that includes the fixing roller and a heater configured to generate heat for thermally fixing the developer image on the sheet.

13. The image forming device according to claim 12, wherein the fixing roller is integrated with the heater.

* * * * *